United States Patent [19]

Snyder

[11] Patent Number: 4,711,053

[45] Date of Patent: Dec. 8, 1987

[54] APPARATUS FOR END FINISHING A LIGHTGUIDE FIBER TERMINATION

[75] Inventor: Donald Q. Snyder, Marietta, Ga.

[73] Assignee: American Telephone and Telegraph Company, AT&T Bell Laboratories, Murray Hill, N.J.

[21] Appl. No.: 925,575

[22] Filed: Oct. 31, 1986

Related U.S. Application Data

[60] Division of Ser. No. 793,948, Nov. 1, 1985, Pat. No. 4,649,670, which is a continuation of Ser. No. 496,163, May 19, 1983, abandoned.

[51] Int. Cl.[4] ..... B24B 13/00

[52] U.S. Cl. ..... 51/3; 51/56 R

[58] Field of Search ..... 51/283 R, 283 E, 284 R, 51/284 E, 326, 327, 5 C, 3, 56 R; 125/13 R, DIG. 1

[56] References Cited

U.S. PATENT DOCUMENTS

| | | | |
|---|---|---|---|
| 2,382,257 | 8/1945 | Ramsay | 51/3 |
| 2,398,387 | 4/1946 | Muller | 51/3 |
| 2,617,236 | 11/1952 | Allen et al. | 51/101 |
| 2,685,766 | 8/1954 | McGovern | 51/34 |
| 2,710,563 | 6/1955 | Messmer | 90/14 |
| 3,368,309 | 2/1968 | Wrobbel et al. | 51/37 |
| 3,847,696 | 11/1974 | Ortner et al. | 156/154 |
| 3,864,018 | 2/1975 | Miller | 350/96 C |
| 3,868,794 | 3/1975 | Zitkus | 51/216 H |
| 3,975,865 | 8/1976 | Lewis | 51/170 T |
| 4,255,164 | 3/1981 | Butzke et al. | 51/295 |
| 4,379,771 | 4/1983 | Snyder | 264/1.5 |
| 4,384,431 | 5/1983 | Jackson | 51/34 E |

FOREIGN PATENT DOCUMENTS

| | | |
|---|---|---|
| 413430 | 8/1924 | Fed. Rep. of Germany . |
| 152574 | 11/1981 | Japan . |
| 112638 | 11/1925 | Switzerland . |

*Primary Examiner*—Frederick R. Schmidt
*Assistant Examiner*—Robert A. Rose
*Attorney, Agent, or Firm*—Edward W. Somers

[57] ABSTRACT

In an apparatus (20) for end finishing an assembly (22) comprising a plurality of lightguide fibers (23—23) positioned between two silicon chips (26—26), a tool carriage (45) is moved past the assembly which at first is held in a fixed position with respect to a path of travel of the carriage. A profiling wheel (110) which is mounted rotatably on the carriage severs a portion of the chips and fibers from the assembly to provide an end portion having a predetermined end configuration. Subsequently, a grinding wheel (131) and a polishing wheel (141) are moved past the newly formed end of the assembly to grind and polish a surface of the end portion and ends of the fibers which terminate in the surface. These last two operations are accomplished while forces are applied to the assembly to bias it toward the tool carriage to provide a controlled pressure and avoid the removal of excess material from the surface and fibers.

11 Claims, 13 Drawing Figures

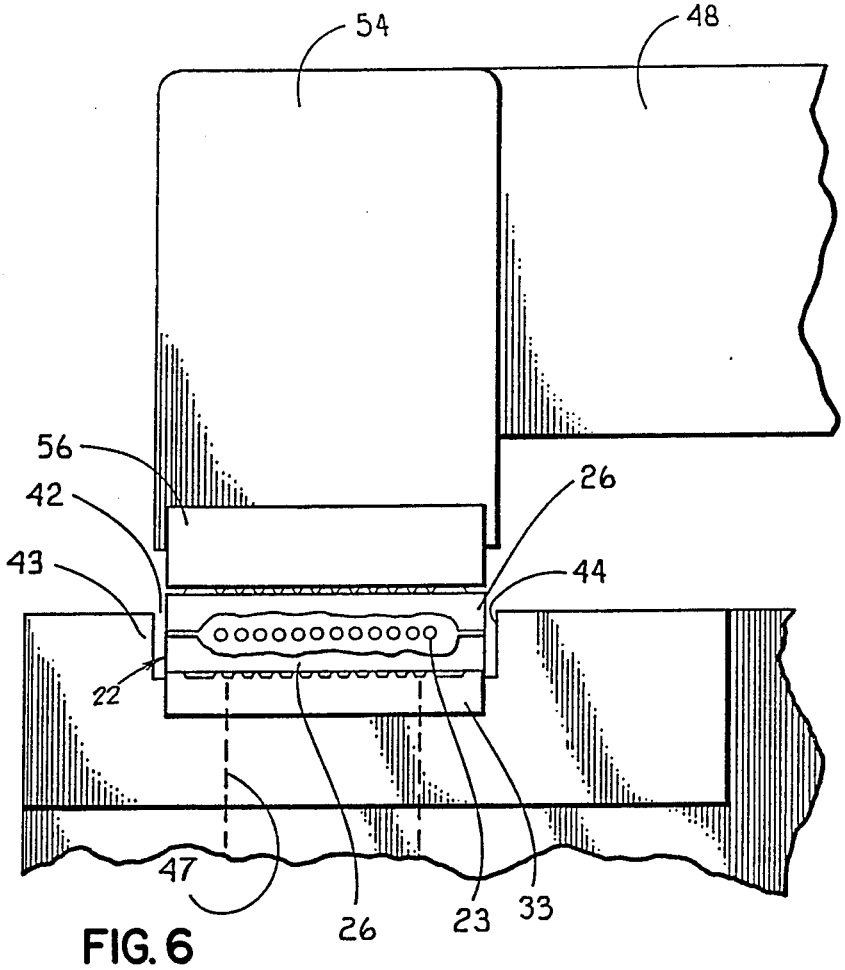
FIG. 6
FIG. 11
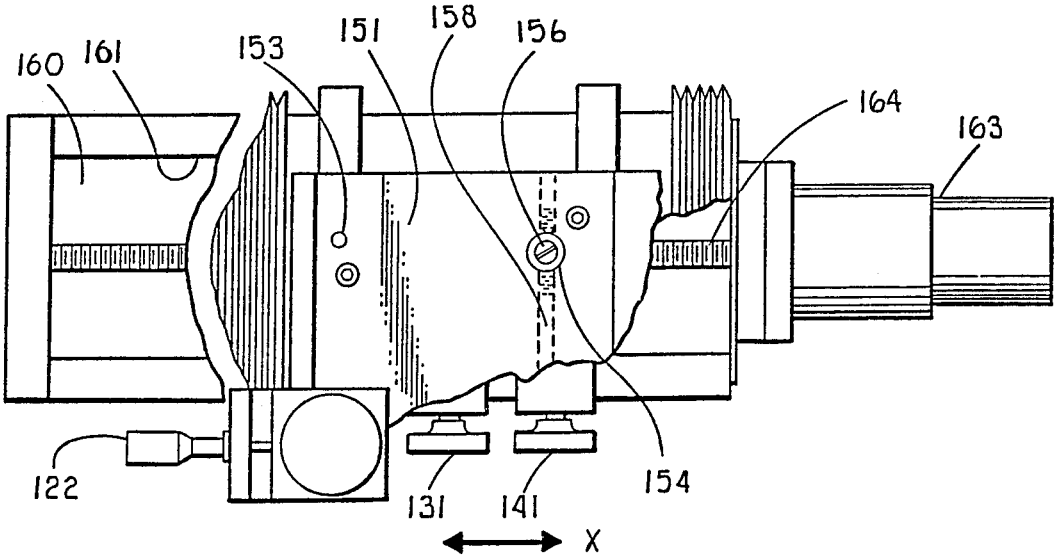

APPARATUS FOR END FINISHING A LIGHTGUIDE FIBER TERMINATION

CROSS REFERENCES TO RELATED APPLICATIONS

This application is a division of Ser. No. 793,948, filed 11-1-85 now U.S. Pat. No. 4,649,670 which is a continuation of application Ser. No. 496,163 filed May 19, 1983, now abandoned.

TECHNICAL FIELD

This invention relates to apparatus for end finishing a lightguide fiber termination. More particularly, it relates to apparatus for preparing an end of an assembly of a plurality of lightguide fibers and enclosing substrates for connection with another such assembly.

BACKGROUND OF THE INVENTION

Lightguide fibers which are now producible are capable of competing favorably with other communication transmission media. This capability requires that economical splicing techniques be available for lightguide fiber systems. The linking of two fibers requires precise axial alignment and end separation. As one can imagine, the splicing of two lightguide fibers each having a diameter in the range of 50 microns is not an easy task. Splicing becomes even more of a problem for a plurality of lightguide fibers of an array such as, for example, a fiber ribbon which may comprise twelve individual fibers. The problem in splicing an array of fibers is to be able to position a first end of one array adjacent to a similar end of another array so that corresponding fibers are all in precise axial alignment.

A connector arrangement for splicing arrays of lightguide fibers is shown in U.S. Pat. No. 3,864,018, which issued on Feb. 4, 1975 in the name of C. M. Miller. Lightguide fibers are terminated in a duplicatable manner by a terminator in the form of substrates, which are called chips and which have spaced, parallel fiber-receiving grooves and ridges on top and bottom surfaces. Fibers of an array are held in aligned, opposing grooves of two chips, which are referred to as positive chips and which presently are made of a silicon material. The assembly of positive chips and fibers is potted to maintain the precision geometry of the array. A spice includes a butt joint of two such arrays which are aligned with respect to each other by so-called negative chips which span over the butted positive chips on each side of the assembly. The negative chips each have a plurality of grooves and ridges which are aligned with the ridges and the grooves of the positive chips to maintain the geometry. Clips are installed about the assembly to secure together the chips.

Methods and apparatus are available to facilitate the termination of lightguide fiber arrays with positive chips to prepare the fibers for splicing. For example, a vacuum chuck which may be used for such a purpose is described in an article by A. H. Cherin et al entitled "Vacuum-Assisted Silicon Chip Multifiber Chuck" as published in Vol. 16 of Applied Optics in June 1977. Also, in a process disclosed in U.S. Pat. No. 4,379,771 which issued on Apr. 12, 1983 in the name of D. Q. Snyder, a positive chip is positioned in a nest after which an end portion portion of a ribbon is moved longitudinally to cause the individual fibers to be separated by a comb-like device adjacent one end of the nest. Another positive chip is placed over the fibers so that the fibers are held in channels formed by the opposing grooves. Afterwards, the assembly of chips and fibers is held together with a vise which applies compressive forces to end portions of the assembly along a longitudinal centerline of the assembly. The vise is heated to cause a potting compound applied to the assembly to fill the interstices thereof to bond together the chips and fibers.

The assembly produced by the methods and apparatus of the aforementioned D. Q. Snyder patent includes lightguide fibers which extend from an end of the assembly and which must be severed. Also the chips must have planar end faces which are normal to the longitudinal axes of the fibers. In order to facilitate a connection of two lightguide fiber positive chip assemblies between the negative chips, those end faces must be profiled to have beveled top and bottom portions.

As should be expected, the geometry of the silicon chips of the assembly is very important from the standpoint of controlling transmission loss. Parameters of the chips must be maintained within very close tolerances. This matter is discussed in an article by D. Q. Snyder entitled "Lightguide Connector Component Characterization" which was published at page 209 in the proceedings of the International Wire and Cable Symposium that was held on Nov. 13 through 15, 1979.

What needed apparatus for end finishing an assembly of lightguide fibers and silicon chips. This must be accomplished so that one side of the end portion of the array of fibers measured transversely of the array is not out of plane more than six microns from the other side.

SUMMARY OF THE INVENTION

The foregoing problems have been overcome by the apparatus of this invention.

An apparatus for preparing an end of an assembly of lightguide fibers and first and second enclosing substrates includes nest means for holding the assembly with the ends of the substrates being in a predetermined location along a reference axis such that movement along that axis is prevented. A tool carriage which includes a profiling wheel, a grinding wheel and a polishing wheel is provided. The apparatus includes facilities for moving the tool carriage along a path of travel in a direction normal to the reference axis. The profiling wheel is caused to be rotated as it is moved past the assembly to remove a portion of the assembly to form an end portion having a predetermined profile. The assembly is released to permit movement along the reference axis and the tool carriage is moved farther along the path normal to the reference axis to align the assembly with the grinding wheel and subsequently with the polishing wheel. Relative motion is caused to occur between the assembly and the grinding wheel and then the polishing wheel to allow the grinding and polishing wheels to finish a surface of the end portion and ends of the fibers which terminate in the surface. During the time when the assembly is engaged with the polishing and grinding wheels, forces are applied to the assembly to hold the surface of the end portion in engagement with the grinding and polishing wheels to provide a controlled pressure between the surface and those wheels.

BRIEF DESCRIPTION OF THE DRAWINGS

Other features of the present invention will be more readily understood from the following detailed description of specific embodiments thereof when read in conjunction with the accompanying drawings, in which:

FIG. 6 is a detail view of a nest which is included in the portion of the apparatus shown in FIG. 5;

FIG. 11 is a detail view of a mounting arrangement for the tool carriage which permits it to be adjusted with respect to the assemblies held in the portion of the apparatus of FIG. 5;

DETAILED DESCRIPTION

Figure 1:
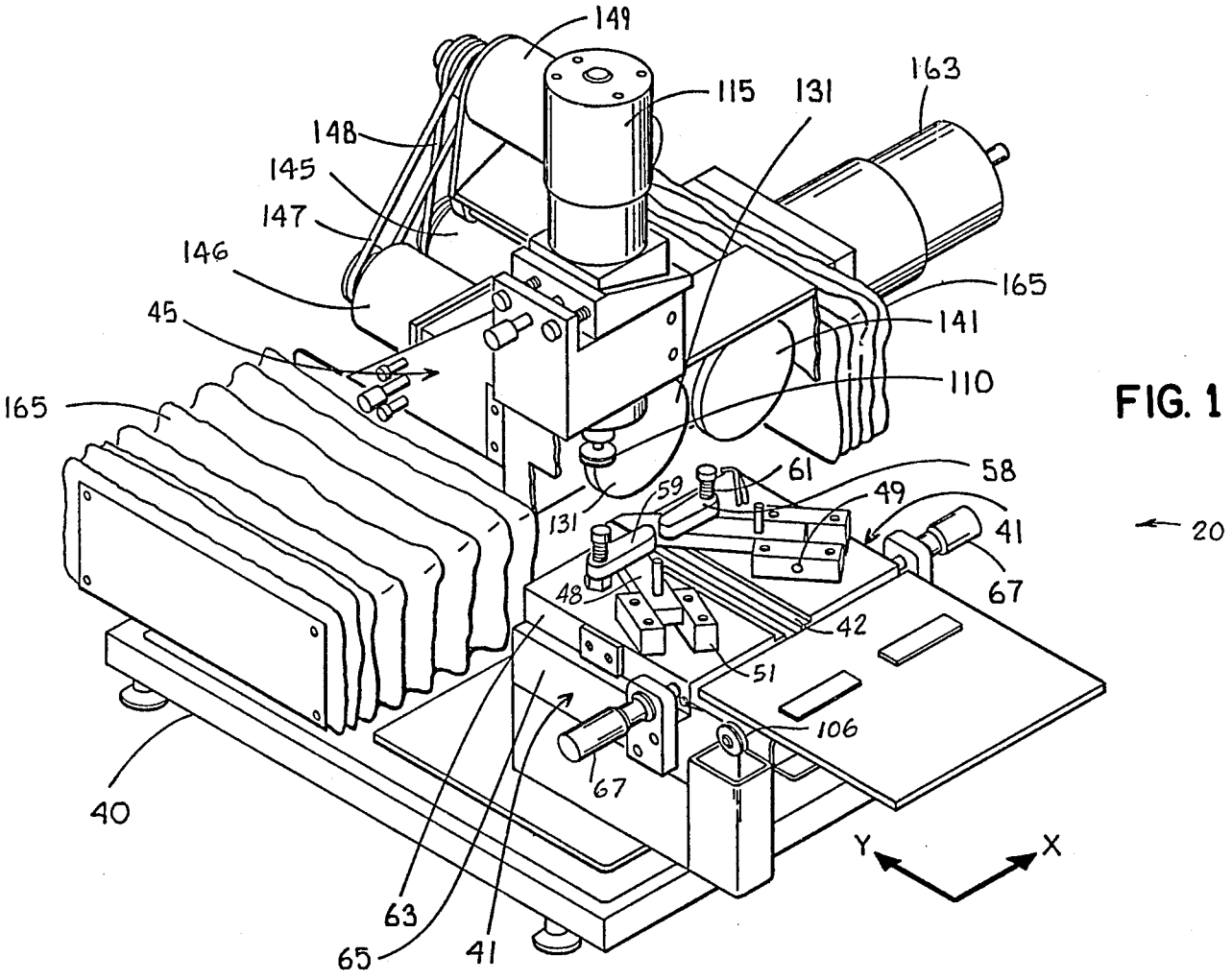
FIG. 1 is a perspective view of an apparatus for end finishing an assembly of lightguide fibers and connector chips.

Referring now to FIG. 1 there is shown an apparatus designated generally by the numeral 20 which is used to end finish a fiber lightguide assembly. The lightguide fiber assembly includes at least one lightguide fiber and a terminator which houses an end portion of the fiber. The preferred embodiment of this invention will be described with respect to the end finishing of a lightguide fiber ribbon assembly 22 which is shown in FIG. 2.

Figure 2:
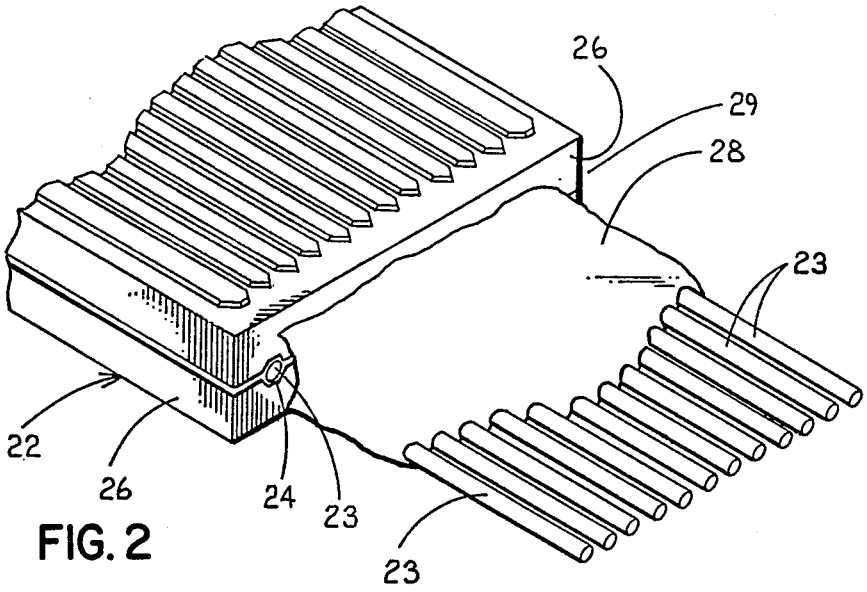
FIG. 2 is a perspective view of an assembly of lightguide fibers and connector chips prior to end finishing.

As can be seen in FIG. 2, the assembly 22 includes a plurality of lightguide fibers 23—23 of a ribbon 25. The fibers 23—23 are held between portions of a terminator in the form of a pair of silicon substrates 26—26. The silicon substrates are referred to as chips and, more particularly, those designated 26—26 are referred to as positive chips. Each of the fibers 23—23 is received in a channel formed by opposing grooves 24—24 between the two opposed silicon chips 26—26. For an apparatus which is used to prepare the assembly of lightguide fibers ribbons and positive silicon chips, see the priorly identified D. Q. Snyder U.S. Pat. No. 4,379,771 which is incorporated by reference hereinto. After that assembly, an epoxy potting material 28 is used to encapsulate the end portions of the lightguide fibers at one end 29 of the assembly.

After the lightguide fibers 23—23 and positive silicon chips 26—26 have been assembled together by the above-mentioned D. Q. Snyder methods and apparatus, a portion of each of the lightguide fibers extends beyond the chips. Those portions of the fibers 23—23 which extend beyond the end of the assembly 22 that is destined to abut the end of another such assembly must be cut off (see FIG. 3). This is necessary inasmuch as the assembly 22 will be interconnected or spliced with another assembly of positive silicon chips 26—26 and ligthguide fibers 23—23 between two negative silicon chips 33—33 having grooves (see FIG. 4) which match the grooves of the positive chips. The negative chips 33—33 are held in engagement with the positive chips 26—26 by clips 36—36.

It is important to the splice that the ends of the two assemblies 22—22 including the positive silicon chips 26—26 have end surfaces 37—37 (see FIG. 3) which are substantially normal to the longitudinal axis of the array of fibers 23—23. Also, an optical grade finish is required for the ends of the lightguide fibers 23—23 which terminate in the surface 37. One end of the surface 37 of assembly 22 must not deviate more than six microns from a plane through the other end and normal to the array. Also, it is important that the ends of each of the assemblies 22—22 have beveled portions 38—38 which terminate in the center surface 37 comprising end surfaces of the chips 26—26 and the potting material 28. This is done in order to facilitate the assembly of the positive and negative chips 26—26 and 33—33, respectively, and to prevent damaging of the ends of the substrates during a splicing operation. Consequently, the end of the assembly 22 must be profiled to provide the beveled top and bottom portions 38—38 of the end surfaces.

Referring again to FIG. 1, it is seen that the apparatus 20 includes a base 40 which supports a pair of heads 41—41 and a tool carriage designated generally by the numeral 45. The heads are mounted for movement along one axis, designated a Y axis, and the tool carriage 45 is mounted for movement generally along an X axis. The heads 41—41 include facilities for holding the lightguide fiber ribbon assemblies 22—22 which have been prepared by the apparatus for the priorly identified Snyder patent during the time in which the end surfaces thereof are prepared for their use in the final lightguide connector between two of the negative chips 33—33.

Figure 5:
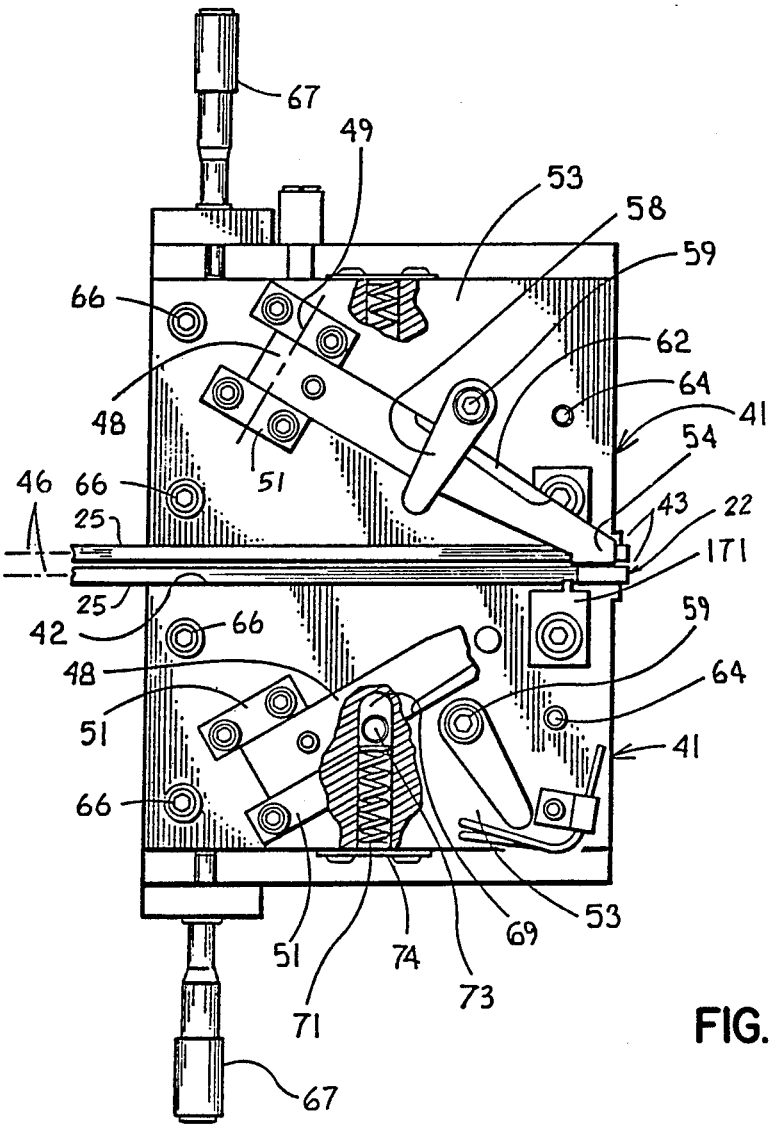
FIG. 5 is a plan view of a portion of the apparatus of FIG. 1 which is used to hold two of the assemblies.

As can be seen in FIGS. 5 and 6 each of the heads 41—41 includes a channel 42 for receiving and for holding the lightguide and chip assembly 22 during the end finishing operations. The leading end of each channel comprises a nest 43 which is provided with a negative silicon chip 33 with which one of the positive chips 26—26 of the assembly may be mated for securance within the nest. The assembly 22 is held in a position fixed along a reference axis 46 through the next 43 and the assembly 22. This position is such that at least portions of the lightguide fibers 23—23 between the chips 26—26 have their longitudinal axes parallel to the reference axis 46. The negative chip 33 is disposed in the bottom of the channel 42 with a spacing between the sides of the negative chip and side walls 44—44 of the channel. Further, the negative silicon chip 33 is provided with at least one or more openings 47—47 which communicate with a source of vacuum (not shown). The vacuum assists in holding the assembly 22 in the nest 43 until additional securing facilities are actuated.

Facilities are provided for securing the assembly 22 in the nest 43. An arm 48 is mounted pivotally about a pin 49 (see FIG. 1) held between two bearing blocks 51—51 on a top surface 53 of each head. An underside of an unsupported end 54 of each arm 48 is provided with a pad 56 of compliant material. The arm 48 is adapted to be moved pivotally downwardly to engage the pad 56 with the top positive silicon chip 26 of the assembly in the nest 43.

The apparatus 20 also includes provisions for holding the arm 48 in engagement with the assembly 22. A locking lever 58 is adapted to be moved into engagement with a top surface of the arm 48. As can be seen, the locking lever 58 is mounted pivotally on a headed pin 59 having a compression spring 61 (see FIG. 1) between the head of the pin and the locking lever. In order to move the locking lever into engagement with the top surface of the arm 48, the operator moves the locking lever across the arm. This causes the locking lever to ride along a camming surface 62 and be moved upwardly against the bias of the spring 61. When it is disposed atop the arm 48, the lever 58 is in locking engagement with the arm 48. This causes the unsupported end 54 of the arm to be engaged with the silicon chip and lightguide fiber assembly 22 to hold it within the nest.

Each of the heads also includes a top portion 63 (see FIG. 1) to which the locking levers 58—58 and arms 48—48 are mounted. Each top plate portion 63 is mounted pivotally about a pin 64 (see FIG. 5) in order to be able to adjust the longitudinal axes of the fibers of the lightguide fiber and chip assembly 22 with respect to the direction of travel of the tool carriage 45. The top plate portion 63 is secured to a slide 65 by upstanding fasteners 66—66. In order to adjust the orientation of the lightguide fibers 23—23 of the assembly 22 in each nest 43, each head 41 is also provided with a micrometer 67. After the angle of the leading surface of the assembly 22 is determined, the micrometer may be turned in a direction to pivot the top plate portion 63 and hence the assembly and the fibers. Further, each top plate portion 63 includes a bore 69 in which is disposed a compression spring 71. The spring 71 engages a pin 73 which is upstanding from the slide 65 and a plate 74 to bias the head outwardly from a centerline between the two heads toward the associated micrometer 67 and pin 64. This arrangement secures the head 41 relative to the base and prevents any unintended movement during the finishing operation.

Figure 7:
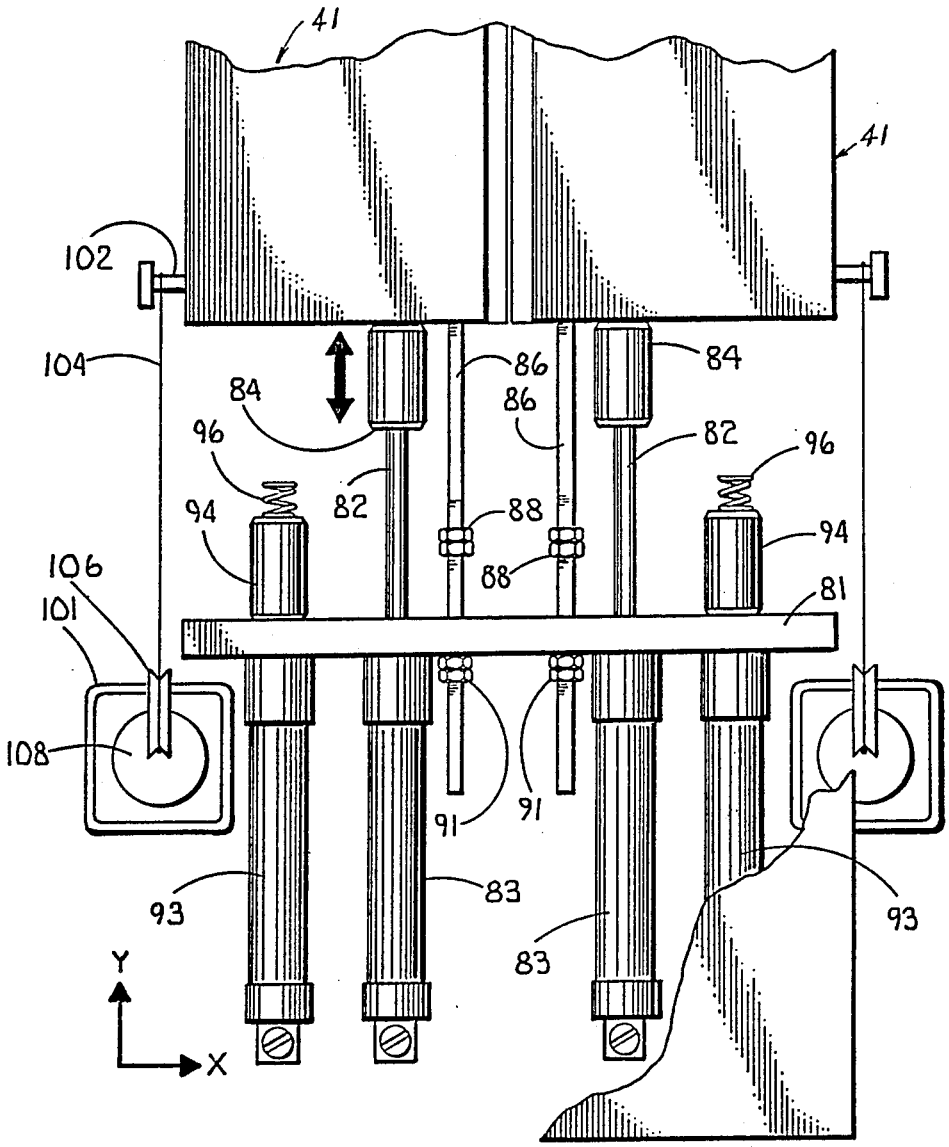
FIG. 7 is a plan view of an arrangement for holding the nest of FIG. 6 in a predetermined position with respect to a tool carriage.

Referring now to FIG. 7, it is seen that each of the heads 41—41 also is provided with a system for moving the head inwardly and outwardly along the Y axis. As is shown, each of the heads 41—41 is spaced from an abutment plate 81 which extends vertically and through which extend piston rods 82—82 from two inner hydraulic cylinders 83—83. Each of the piston rods 82—82 has an enlarged portion 84 attached to an end thereof. Each of the hydraulic cylinders 83—83 is adapted to engage the enlarged portion 84 of its piston rod with one of the heads 41—41. Also, each of the heads 41—41 has a horizontally extending rod 86 having first and second pairs 88—88 and 91—91 of stop nuts at spaced locations therealong. One pair 88 of the stop nuts for each rod 86 is on one side of the vertically extending abutment plate 81 while the other pair of the stop nuts is on the other side thereof.

Of further use in controlling the position of the heads 41—41 are an outer, second pair of hydraulically operated cylinders 93—93. Each of these cylinders has its piston rod extending through the abutment plate and has an enlarged portion 94 attached thereto. In addition, the enlarged portions 94—94 which are associated with these two last mentioned cylinders have compression springs 96—96 which project from their leading ends.

The heads 41—41 are normally biased toward the abutment plate 81. This is accomplished by a pulley and weight arrangement 101. Each head 41 is provided with a stud 102 to which an end of a cable 104 is attached. The cable 104 is passed over a sheave 106 and attached to a weight 108.

In FIG. 7, the cylinders 83—83 are shown in an operated condition with the piston rods 82—82 extended. When these, as well as the piston rods of the cylinders 93—93 are unoperated, the weights 108—108 are effective to cause the heads 41—41 to be biased downwardly as viewed in FIG. 7 until the stop nuts 88—88 engage the abutment plate 81.

Figure 8:
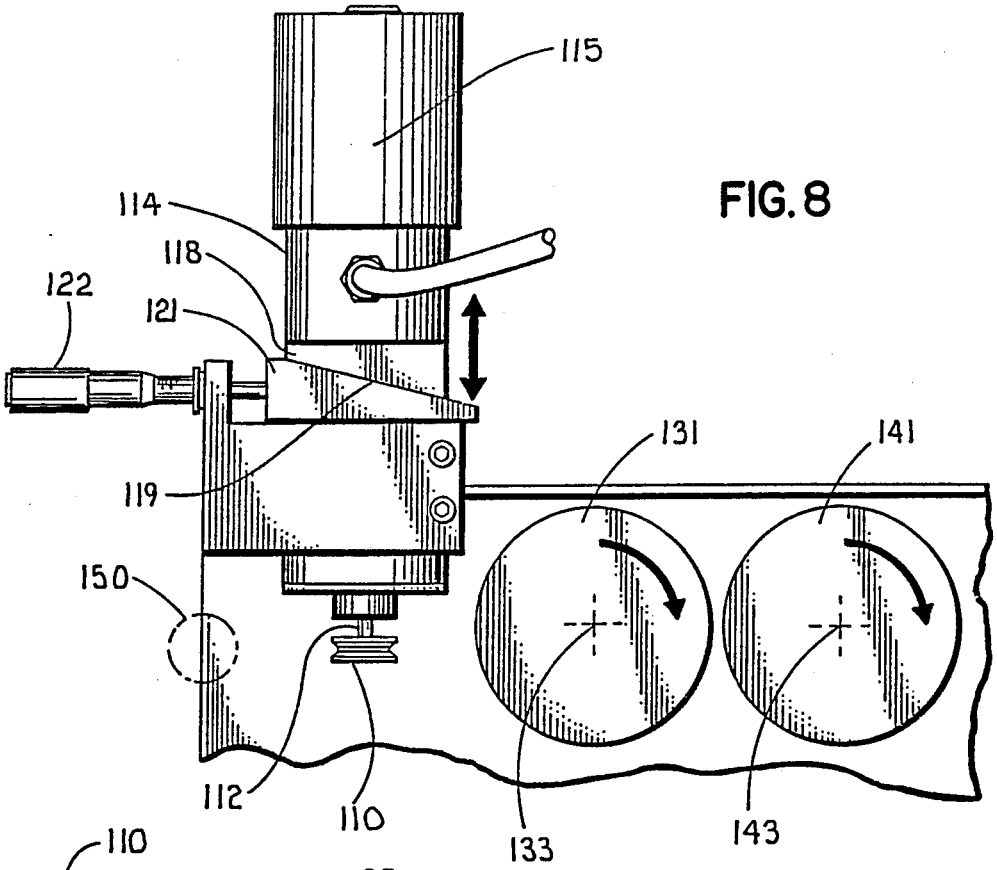
FIG. 8 is a front elevational view of the tool carriage which includes tools for end finishing the assembly of FIG. 2.
Figure 9:
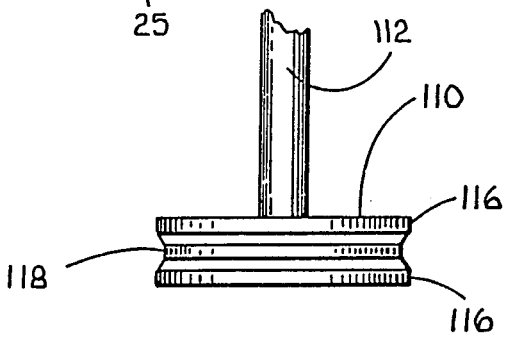
FIG. 9 is a detail view of a profiling wheel which is mounted on the tool carriage.

From FIGS. 1 and 8, it can be seen that the tool carriage 45, includes a high speed cutoff wheel 110 which is disc-shaped and which has an axis of rotation which extends vertically. The high speed cutoff wheel 110 is a wheel having a relatively hard outer surface. For example, the wheel 110 may be made of steel and plated with diamond particles or it could comprise a resinous material which includes diamond particles. The high speed cutoff wheel 110 is attached to a shaft 112 which is connected to a driving means 114 such as an air driven turbine which is attached to the tool carriage. A muffler 115 connected to the driving means 114 maintains the noise level at acceptable levels. In order to cause the end of the assembly to have the configuration shown in FIG. 3, the high speed cutoff wheel 110, which is operated in a range of about 65,000 rpm is profiled as shown in FIG. 9. It has two extreme spaced portions 116—116 which have orthogonal vertical edges with a portion 118 interposed therebetween to provide the beveled portion 38 for the assembly 22 of chips and lightguide fibers.

As can be seen particularly in FIG. 8, the driving means 114 for the high speed cutoff wheel is mounted on a bearing plate 118 having an inclined surface 119 which mates with an adjustment shim plate 121 that is movable to the right or left by a micrometer 122. This arrangement is used in order to align the high speed cutoff wheel 110 with the assemblies 22—22 in the nests 43—43 in a vertical direction. It is important that the beveled surfaces 38—38 of each assembly 22 that are formed by the profiling wheel 110 be located accurately in a vertical direction in order to cause the assembly to be aligned substantially perfectly with another when held between the same two negative chips 33—33. Should the operator determine that the beveled surfaces are out of alignment, the micrometer 122 can be turned to move the threaded portion thereof and hence move the shim plate 121 to the right or left as viewed in FIG. 8. This will cause the driving means 114 to be moved up or down and thereby position the beveled surfaces 38—38 accurately with respect to the assembly 22.

The tool carriage 45 also includes a grinding wheel 131 which is rotatably mounted about an axis 133 and which is designed to rotate at a rotational velocity of about 1,000 rpm. This particular grinding wheel is referred to as a finish grinding wheel and is mounted with a horizontal axis of rotation. As shown in FIG. 8, it is turned rotatably in a cockwise direction. In a preferred embodiment, the grinding wheel 131 includes a silicon carbide grinding material attached to a Mylar® plastic backing adhered to a steel wheel.

Adjacent to the finish grinding wheel 131 is a polishing wheel 141 which also is mounted rotatably about a horizontal axis 143 and which is designed to be rotated at a speed of about 1,000 rpm. The polishing wheel includes a steel disc having a pad which is provided with a diamond paste adhered thereto. The polishing wheel 141 is turned at a rotational velocity substantially less than that of the cut off wheel 110. This is done to avoid the use of excessive amounts of coolant which could result in the removal of the polishing grit from the wheel. These two wheels are flushed with water during their operation.

Figure 10:
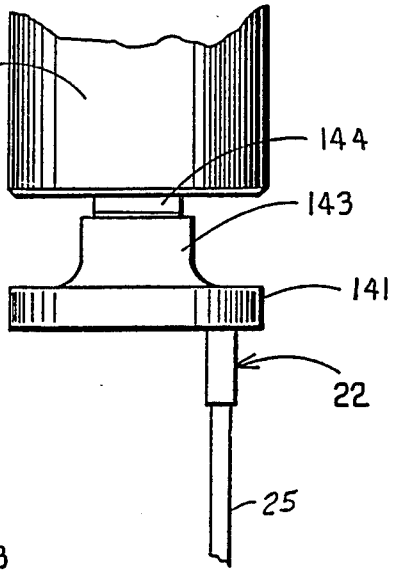
FIG. 10 is a detail view of a polishing wheel which is mounted on the tool carriage.

It is important in the grinding and polishing of the assembly 22 described hereinbefore that the wheels 131 and 141 be maintained in alignment with each other. With wheels of these kinds, it is not unusual for them to be mounted on shafts having a diameter of about between 0.13 inch and to be received in a chuck connected to a driving mechanism. This would not provide the rigidity which is required with respect to a vertical plane in the apparatus 20. In order to overcome this, specially designed grinding and polishing wheels are used with respect to the tool carriage 45 (see FIG. 10). For example, as shown in FIG. 10, the wheel 141 is formed with an enlarged hub 143 having a bore therein such that the hub is designed to be received over a shaft 144 of a spindle 145. The hub 143 has a diameter in the range of about 0.5 inch and causes the grinding and the polishing wheels to be substantially more rigid than would be expected.

As can be seen in FIG. 1, the spindles 145 and 146 for the polishing and grinding wheels 141 and 131, respectively, are turned by belts 148 and 147 which are driven by an electric motor 149. Further, the spindles are such that they are substantially free of any vibration.

Referring to FIG. 8, it is seen that a so-called rough cut wheel 150 which is shown in phantom may be mounted with about a horizontal axis of rotation to the left of the high speed cutoff wheel 110. This rough cut wheel 150 may be used in order to make the first cut to remove portions of the positive silicon chip 26—26 and the lightguide fibers 23—23. The use of a rough cut wheel reduces the wear and prolongs the life of the profiling wheel 110.

Not only are the heads 41—41 adjustable with respect to the X axis, the tool carriage 45 is adjustable with respect to the heads. This is done in order to cause the radial planes of the grinding and polishing wheels 131 and 141, respectively, to be normal to the axes of the assemblies 22—22. To provide this adjustability, the tool carriage 45 is mounted on a plate 151 (see FIG. 11) which is pivotally mounted about a pin 153. An opposite end of the plate 151 includes an opening 154 in which is received a pin 156. The opening 154 is oversized with respect to the pin 156. A set screw 158 is turned from the side of the plate into the opening 154 to engage the pin 156. The disposition of the plate is adjusted by turning the set screw 158 in or out to move pivotally the plate 151.

The tool carriage 45 is adapted to be moved along a path of travel which is normal to the reference axis 46 along which each assembly 22 is held. In order to accomplish this, the tool carriage 45 is supported on a slide 160 (see FIG. 11) mounted in a guideway 161 which extends transversely past the heads 41—41. A drive motor 163 and lead screw arrangement 164 cause the carriage 45 to be moved along the guideway. As can be seen in FIG. 1, an expandable shield 165 at each end of the guideway is effective to protect the guideway from dust from the cut off, grinding and polishing operations.

Prior to its production operation, the apparatus 20 is calibrated. The operator loads an assembly 22 into each of the nests 43—43 with the vacuum turned on and aligns the assembly longitudinally along the guideway 42 with respect to a reference line gauging device 171 (see FIG. 5) attached to the top surface 53. The operator moves each pivotally associated arm 48 about its horizontal axis to bring the compliant pad 56 into engagement with the assembly in the associated nest. Then the locking lever 58 is moved and camming upwardly over the top surface of the arm 48 and over into alignment with the unsupported end 54 of the arm. The locking lever 58 is biased downwardly into engagement with the arm 48 to lock the assembly 22 in the nest 43. At this point, the vacuum is discontinued and reliance is placed on the clamping mechanism to hold the assembly 22 in the nest 43. The operator causes the apparatus 20 to be operated and the high speed cutoff and profiling wheel 110 to be moved past the heads 41—41 to remove portions of the chips and the fibers. Then the operator discontinues the operation of the apparatus 20, removes the assembly from each nest and measures to determine the angle of the leading vertical surface 37 of the assembly 22 with respect to the reference axis 46. In other words, a determination is made as to whether or not the leading surface 37 is perpendicular to the fiber axis. If necessary, the operator adjusts the micrometers 67—67 on the sides of the heads 41—41 in order to move pivotally the heads about the pins 64—64 and correct for any error in the leading surface 37 of the assembly 22 with respect to the fiber axis. It is necessary that the surface 37 of the newly formed end portion of the chips 26—26 of each assembly 22 be normal to the longitudinal axes of the fibers 23—23. The apparatus is now conditioned for production runs.

The operator positions an assembly 22 in a nest 43 and moves pivotally the associated arm 48 about its horizontal axis to bring the compliant pad 56 into engagement with the assembly as before. Then the locking lever is caused to secure the arm 48 in engagement with the assembly 22 in the associated nest 43. The vacuum is discontinued and this sequence of steps is repeated for an assembly 22 which is positioned in the other nest 43.

The operator then causes the apparatus to become operational to cause the driving mechanism 114 for the high speed cutoff wheel 110 to be turned on. At the same time the apparatus 20 functions to cause the hydraulic cylinders 83—83 to move the heads 41—41 to the upper left as shown in FIG. 1 and upwardly as shown in FIG. 7 until the stop nuts 91—91 on each of the threaded rods 86—86 engage the abutment plate 81. When the stop nuts engage the abutment plate 81, the leading end of each assembly 22 spans across the path of travel of the high speed cutoff wheel 110. Because the heads 41—41 are fixedly positioned with respect to the path of travel of the tool carriage 45 at this time, the position of the assemblies 22—22 is said to be displacement controlled.

Figure 3:
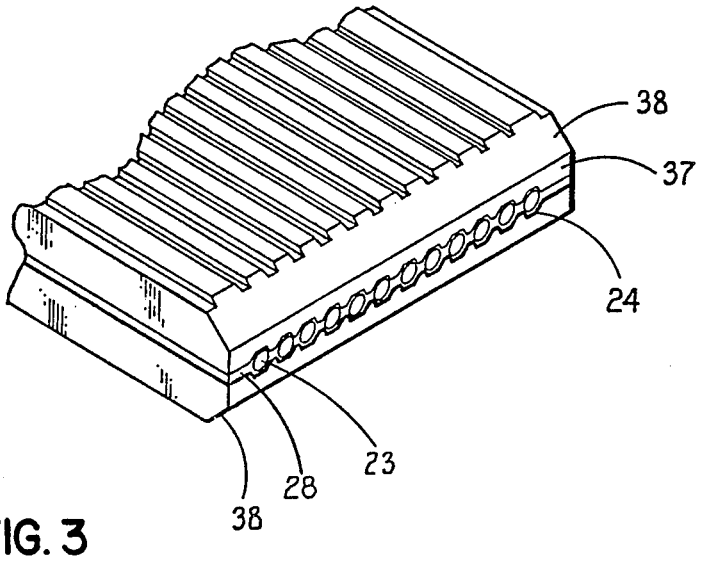
FIG. 3 is a perspective view of the assembly of FIG. 2 after it has been end finished.
Figure 4:
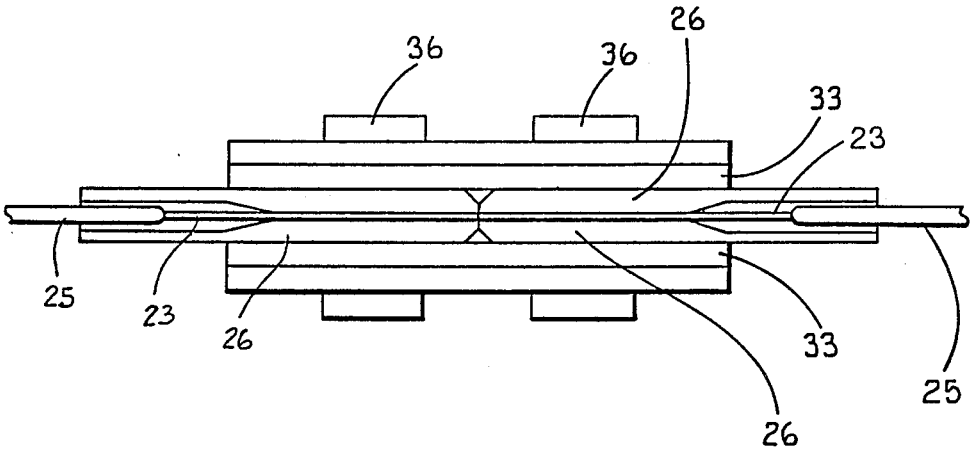
FIG. 4 is a perspective view of two of the assemblies of FIG. 3 connected together to form a splice.
Figure 12:
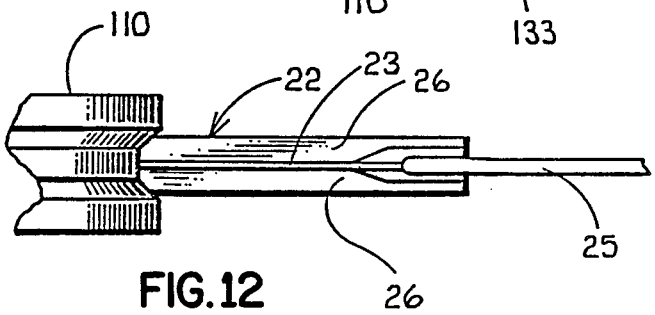
FIG. 12 is a detail view of the profiling wheel in engagement with an assembly of lightguide fibers and connector chips.

Afterwards, the tool carriage 45 is moved to the bottom left as viewed in FIG. 1 in an X direction to cause the cutting wheel 110 to be moved past each of the assemblies 22—22 in the nests 43—43 to remove portions of the silicon chips 26—26 and the lightguide fibers (see FIGS. 3 and 12). Each of the assemblies 22—22 is provided with a newly formed end portion having a predetermined profile. Water is used to lubricate and to cool the high speed cutoff wheel 110 and assemblies 22—22. After the leading portions of the assemblies 22—22 have been severed, the hydraulic cylinders 83—83 are caused to retract the piston rods 82—82 and enlarged portions 84—84 associated therewith out of engagement with the heads 41—41 to allow the heads to be freely movable in a Y direction. It should be noted that the enlarged portions 84—84 attached to the piston rods 82—82 of the middle two hydraulic cylinders 83—83 are not connected to the heads. After the enlarged portions 84—84 have been moved out of engagement with the heads, the weights 108—108, which are shown in FIGS. 1 and 7 cause the heads 41—41 to be moved rearwardly until the second pairs 88—88 of stop nuts on the rods 86—86 engage the abutment plate 81.

Then the tool carriage 45 is moved to position the grinding wheel 131 in alignment with each of the assemblies 22—22. The two outside hydraulic cylinders 93—93 are actuated to move their piston rods toward the heads 41—41 whereupon the springs 96—96 engage the heads and provide a cushioned engagement between the heads and the piston rods. This brings the leading ends of the assemblies 22—22 into engagement with the grinding wheel 131. This cushioned engagement is unlike the rigid engagement during the cut off operation. A fixed engagement of the carriage at this point is not in order inasmuch as the deep scratches could be imparted to the silicon chips 26—26.

At this time, the engagement of the free end portions of the assemblies 22—22 with the wheel 131 is said to be force controlled. A controlled pressure between the ends of the assemblies 22—22 and the wheel 131, as well as with the polishing wheel 141, is desired. Because the end surface areas are established by the profile formed by the cutting wheel 110, the forces applied must be controlled to achieve that pressure. This is accomplished with suitable springs 96—96 and by adjusting the displacement of each.

The tool carriage 45 is moved along the X axis at the same speed in which it was moved during the high speed cutoff operation to cause a finish grinding operation to be performed on each of the assemblies 22—22. The wheel 131 grinds each end surface 37 which comprises the newly formed ends of the chips 26—26 and the potting material 28, and the fiber ends which terminate in that surface. During this time the pad on the finish grinding wheel 131 is flushed with water.

Afterwards, the outside two cylinders 93—93 are operated to retract the enlarged portions 94—94 and piston rods and the tool carriage 45 is moved to position the polishing wheel 141 in alignment with the assemblies 22—22. At that time, the outside hydraulic cylinders 93—93 are actuated once again to engage the heads 41—41 with the springs 96—96 and hold the surfaces 37—37 of the assemblies 22—22 in engagement with the polishing wheel 141. As the polishing wheel is moved past the assembies 22—22, the speed of the carriage 45 is about three times as fast as it is during the cuttoff and grinding steps. The carriage 45 is moved across the assemblies 22—22 and then in a reverse direction for about two-thirds the length of its original travel. During this time, water is applied to prevent diamond particles from lodging in the pad which would lead to a rough finish. Afterwards, the cylinders 93—93 are operated to once again disengage the piston rods from the heads 41—41. Then the operator disengages the locking levers 58—58 and arms 48—48, and removes the finished assemblies 22—22 from the nests 43—43.

Figure 13:
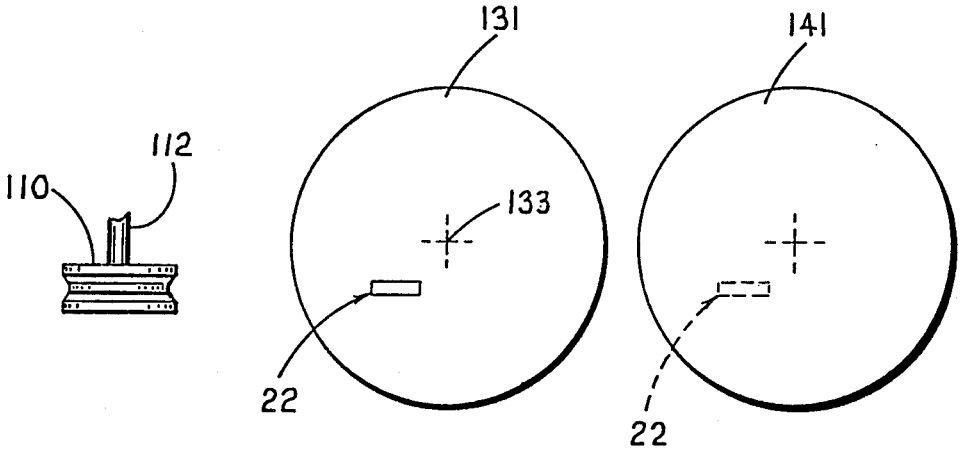
FIG. 13 is an elevational view which shows the relative elevations of portions of the tool carriage and an assembly which is held in the portion of the apparatus shown in FIG. 5.

During the grinding and polishing operations, the assemblies 22—22 are positioned so that they are spaced below the axes of rotation of the grinding and polishing wheels (see FIG. 13). Generally, this distance is about 0.2 inch. If they were to be moved through the centers of the wheels 131 and 141, grinding and polishing effectiveness would be less inasmuch as these are points of zero velocity. Further, if the assemblies 22—22 were to be moved through the rotational axes of the wheels 131 and 141, the grinding and polishing would occur generally in vertically opposed passes which tends to result in grooves. This is particularly true since the assembly face 37 is a composite of glass, epoxy and silicon. By offsetting the assemblies from the rotational axes, the grinding and polishing passes across the end surfaces 37—37 of the assemblies 22—22 alternate between vertical and horizontal which minimizes non-flatness of the end surfaces.

It is to be understood that the above-described arrangements are simply illustrative of the invention. Other arrangements may be devised by those skilled in the art which will embody the principles of the invention and fall within the spirit and scope thereof.

What is claimed is:

1. An apparatus for preparing an assembly, which includes at least one lightguide fiber and a terminator, for connection with another assembly, said apparatus comprising:

nest means for holding the assembly in a position along a reference axis with a length of the fiber which is disposed within the terminator being parallel to the axis;

a first tool which is adapted to provide the assembly with an end portion having a predetermined profile;

moving means for causing relative motion between the assembly and the first tool along a path of travel which is normal to the reference axis;

means for controlling the first tool to remove portions of the terminator and of the fiber to provide the assembly with the end portion having the predetermined profile;

means for preventing movement of the assembly along the reference axis during the formation of the end portion having the predetermined profile and for then releasing the assembly for movement along the axis;

a second tool which is adapted to finish a surface of the end portion and an end of the fiber which terminates in the surface;

means for applying resilient biasing forces to the assembly to hold the surface of the end portion in engagement with said second tool to provide a controlled pressure between the surface and said second tool; and means for causing relative motion between the assembly and said second tool in a direction normal to the reference axis to allow the second tool to finish the surface of the end portion and the end of the fiber.

2. An apparatus for preparing an assembly of lightguide fibers and enclosing substrates for connection with another assembly, said apparatus including:

nest means for holding the assembly in a position along a reference axis with portions of the fibers enclosed by the substrates being parallel to the axis;

a first tool which is adapted to provide the assembly with an end portion having a predetermined profile;

moving means for causing relative motion between the assembly and the first tool in a direction normal to the axis;

means for controlling the first tool to remove portions of the substrates and of the fibers to provide the assembly with the end portion having the predetermined profile;

means for preventing movement of the assembly along the reference axis during the formation of the end portion having the predetermined profile and for then releasing the assembly for movement along the axis;

a second tool which is adapted to finish a surface of the end portion and ends of the fibers which terminate in the surface:

means resiliently biasing the assembly in a direction along the reference axis for applying forces to the assembly to hold the surface of the end portion in engagement with said second tool to provide a controlled pressure between the surface and said second tool; and means for causing relative motion between the assembly and said second tool in a direction normal to the axis to allow the second tool to finish the surface of the end portion and the ends of the fibers.

3. An apparatus for preparing an assembly of lightguide fibers and enclosing substrates, said apparatus including:

nest means for holding the assembly in a position along a reference axis with portions of the fibers enclosed by the substrates being parallel to the axis;

securing means for preventing movement of the assembly along said reference axis;

tool means for providing the assembly with an end portion having a predetermined profile and end finish, said tool means including a profiling wheel and a polishing wheel;

means for mounting said profiling wheel for rotation about an axis which is normal to the reference axis and said polishing wheel for rotation about an axis which is parallel to the reference axis;

means for mounting said tool means for movement along a path of travel which is normal to the reference axis and to the axis of rotation of said profiling wheel;

means for rotating said profiling wheel when said profiling wheel is moved past the assembly to cause said profiling wheel to remove portions of the substrates and ends of the fibers to form an end portion having a predetermined configuration:

means for releasing the assembly to permit movement along the reference axis;

force applying means resiliently biasing the assembly in a direction along the reference axis while the assembly is capable of movement along the reference axis for holding a surface of the end portion of the assembly in engagement with said polishing wheel when said polishing wheel is aligned with the assembly to provide a controlled pressure between the surface and said polishing wheel; and means for moving said tool means along the path of travel to cause said profiling wheel to provide the assembly with the end portion having the predetermined configuration, to cause said polishing wheel to be aligned with the assembly and render effective said force applying means, and to cause said polishing wheel to finish the surface of the end portion and ends of the fibers which terminate in the surface.

4. The apparatus of claim 3, which also includes means for adjusting the angle between the end portions of the lightguide fibers with respect to the path of travel.

5. The apparatus of claim 3, wherein said tool means also includes a grinding wheel for grinding the surface of the end portion of the assembly and the ends of the fibers prior to the assembly being contacted by said polishing wheel.

6. The apparatus of claim 5, which also includes means for mounting said grinding wheel about an axis of rotation which is parallel to the reference axis, said grinding wheel being effective to grind the surface of the end portion and the ends of the fibers as said grinding wheel is moved past the assembly.

7. The apparatus of claim 6, wherein said grinding wheel comprises a silicon carbide material adhered to a plastic backing.

8. The apparatus of claim 6, wherein the centers of rotation of said polishing wheel and said grinding wheel are spaced vertically from the assembly.

9. The apparatus of claim 3, wherein said apparatus also includes means for severing the assembly prior to the engagement of said profiling wheel with said assembly.

10. The apparatus of claim 3, wherein said moving means is controlled to move said polishing wheel first in one direction past the assembly and then in an opposite direction.

11. The apparatus of claim 3, wherein said tool means also includes adjustable means for controlling the position of said profiling wheel with respect to the assembly along the axis of rotation of said profiling wheel.

* * * * *